US005365243A

United States Patent [19]

Büchler et al.

[11] Patent Number: 5,365,243

[45] Date of Patent: Nov. 15, 1994

[54] PLANAR WAVEGUIDE FOR INTEGRATED TRANSMITTER AND RECEIVER CIRCUITS

[75] Inventors: Josef Büchler; Erich Kasper, both of Pfaffenhofen, Germany

[73] Assignee: Daimler-Benz Aktiengesellschaft, Stuttgart, Germany

[21] Appl. No.: 898,850

[22] Filed: Jun. 15, 1992

[30] Foreign Application Priority Data

Jun. 15, 1991 [DE] Germany ..... 4119784

[51] Int. Cl.[5] ..... H01Q 19/06

[52] U.S. Cl. ..... 343/753; 343/700 MS; 343/767; 333/247

[58] Field of Search ..... 343/700 MS, 753, 755, 343/754, 909, 701, 767, 768, 770; 333/247

[56] References Cited

U.S. PATENT DOCUMENTS

| | | | |
|---|---|---|---|
| 3,305,863 | 2/1967 | Jacobs | 343/18 |
| 4,353,060 | 10/1982 | Handel et al. | 343/18 A |
| 4,777,490 | 10/1988 | Sharma et al. | 343/700 MS |
| 5,005,022 | 4/1991 | Blaisdell | 343/753 |
| 5,091,731 | 2/1992 | Rees | 343/700 MS |

FOREIGN PATENT DOCUMENTS

| | | |
|---|---|---|
| 0190412 | 8/1986 | European Pat. Off. . |
| 0055324 | 8/1990 | European Pat. Off. . |
| 3808251A1 | 9/1989 | Germany . |
| 3920110A1 | 2/1991 | Germany . |
| 2237684 | 5/1991 | United Kingdom . |
| 2237936 | 5/1991 | United Kingdom . |

OTHER PUBLICATIONS

Dale E. Dawson, "Monolithic Circuits Symposium", IEEE 1988 Microwave and Millimeter-Wave, New York, May 1988, 1988, pp. 67–70.

U. Konig, "Chips, Würfel statt Fläche", Mikrowellensender in Dre Ebenen, Funkschau Aug. 1989, pp. 64–67.

Navarro et al, "Active Integrated Antenna Elements", Microwave Journal, Jan., 1991, pp. 115, 117–119, 121–122, 124, 126.

"MMIC-compatible antennas", Electronics & Wireless World, Aug., 1989, pp. 797–798.

Nightingale et al, "A 30-GHz Monolithic Single Balanced Mixer with Integrated Dipole Receiving Element", IEEE Transactions on Microwave Theory ANS Tehcniques, vol. MTT-33, No. 12, Dec., 1985, pp. 1603–1610.

R. H. Mattson, "Proposed Method for Controlling and Minimizing Reflections from a Surface", IRE Transactions on Electron Devices, vol. ED-8, No. 5, Sep., 1961, pp. 386–389.

Perry et al, "MMIC Packaging with Waffeline", Microwave Journal, Jun., 1990, pp. 175, 178, 180–182.

P. D. Patel, "Semiconductor dipole: possible radiating element for microwave/millimetre-wave monolithic integrated circuits (MIMICs)", IEEE Proceedings, vol. 136, No. 6, Dec., 1989, pp. 455–461.

H. Maheri et al, "Experimental Studies of Magnetically Scannable Leaky-Wave Anteanns Having a Corrugated Ferrite Slab/Dielectric Layer Structure", IEEE Transactions on Antennas and Propagation, vol. 36, No. 7, Jul., 1988, pp. 911–917.

Kinzel et al, "V-Band, Space-Based Phased Arrays", Microwave Journal, Jan., 1987, pp. 89–90, 94–96, 89, 100, 102.

Strohm et al, "Silicon Technology for Monolithic Millimeter Wave Integrated Circuits", Mikrowellen & HF Magazin, vol. 14, No. 8, 1988, pp. 750–760.

*Primary Examiner*—Donald Hajec
*Assistant Examiner*—Hoanganh Le
*Attorney, Agent, or Firm*—Spencer, Frank & Schneider

[57] ABSTRACT

A planar waveguide structure for mm-wave transmitters and receivers. The active semiconductor component elements and the planar waveguide with which they are connected of the transmitters and/or receivers are arranged on the front side of a semiconductor substrate. The rear side or surface of the semiconductor substrate is at least partially formed as an inwardly or outwardly radiating surface and is geometrically shaped such that an electromagnetic property incident or emanating radiation is altered in a predetermined manner.

14 Claims, 1 Drawing Sheet

PLANAR WAVEGUIDE FOR INTEGRATED TRANSMITTER AND RECEIVER CIRCUITS

CROSS REFERENCE TO RELATED APPLICATIONS

This application claims the priority of German Application No. P 41 19 784.4 filed Jun. 15, 1991, which is incorporated herein by reference.

BACKGROUND OF THE INVENTION

This invention relates to a planar waveguide structure for transmitters and receivers wherein active semiconductor component elements, which are connected with planar conductors, are arranged on the front side of a semiconductor substrate.

The invention finds application in the manufacture of monolithic integrated millimeter wave transmitters and receivers having beam-forming elements, for example, for radar transmitters and receivers in motor-driven vehicles.

A planar waveguide structure consists of a structured metallization or coating of a substrate, which may be a layered substrate, in one or more planes. By virtue of a special geometric configuration of the metal coating, different structures, for example, couplers, resonators and antennae, may be formed.

Planar waveguides are capable of guiding microwaves. Such waveguides may be coupled with active semiconductor component elements to form monolithic integrated circuits. The semiconductor substrate must be high ohmic or must be a semi-insulator. Silicon is suitable as a high ohmic material, while GaAs is suitable as a material for a semi-insulating substrate.

A planar waveguide structure radiates upwardly, for example, into air, and downwardly, into the substrate. The irradiation into the substrate is in general greater than the outward radiation.

Transmitters and receivers for electromagnetic waves in the millimeter wavelength range having planar waveguide structures are described, for example, in the periodical "Mikrowellen und HF Magazin", Volume 14, N. 8, pages 750–760. The transmitters and receivers in the millimeter wavelength range described therein are manufactured with the silicon monolithic microwave integrated circuit technique. Antennae or lenses are used for shaping, in a predetermined manner, the radiation transmitted by transmitters or received by receivers of this type.

SUMMARY OF THE INVENTION

It is an object of the invention to provide an improved planar waveguide structure for transmitters and receivers in which the shaping of the transmitted or received radiation is effected without additional radiation forming structural elements, so that monolithic integrated transmitters and receivers that have a small spatial requirement may be manufactured in a technologically simple manner.

This object and others to become apparent as the specification progresses, are accomplished by the invention, according to which, briefly stated, the reverse side of the semiconductor substrate of a planar waveguide structure is at least partially formed as an outwardly or inwardly radiating surface, and this surface of the semiconductor substrate, or of an additional layer or layers applied to this surface, Is geometrically shaped such that the electromagnetic properties of the inward and/or outward radiation is varied or altered in a predetermined manner.

DESCRIPTION OF THE PREFERRED EMBODIMENTS

Figure 1:
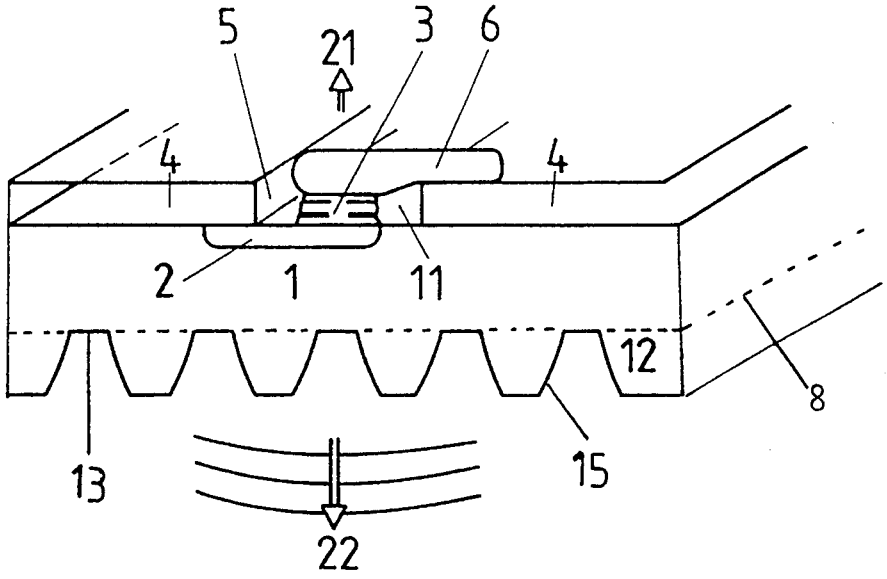
FIG. 1 is a schematic perspective view of a preferred embodiment of the invention.

According to the invention, in a known planar waveguide structure, for example, in a planar antenna or a resonator, the rear side of the Substrate is utilized, either in its entirety or partially, as an inwardly or outwardly radiating surface. Moreover, the rear side of the substrate is structured, for example, by a micromechanical or etching process, such that the inwardly or outwardly radiated electromagnetic wave is changed or altered in a predetermined manner. Special cases of the radiation shaping are, for example, the change of the polarization, the diffraction or refraction of the radiation, and the changing of the phase of the electromagnetic wave. Such radiation shapings may be achieved, for example, by a surface structuring of the rear substrate surface as shown in FIG. 1. In this illustrated embodiment the rear substrate surface 12 has planar faces as well as faces constituting lens portions. Further, the radiation shaping may be achieved by etching depressions with predetermined profiles (diffraction gratings) or by forming reflecting metal structures (for example, concentric circles) or dielectric or ferromagnetic domes on the rear surface 12. The last-mentioned embodiments are indicated in FIG. 1 by the broken line 8 as an interface between the substrate 1 and a structured layer of metal, a dielectric or a ferromagnetic material applied to the rear surface 12.

The planar waveguide structure according to the invention may be transformed advantageously by known techniques, for example, MIC (microwave integrated circuit), MMIC (monolithic microwave integrated circuit), or Si-MMWIC (silicon monolithic microwave integrated circuit) techniques, to planar transmitters or, in case of inward radiation over the substrate rear side, to planar receivers.

FIG. 1 illustrates, in cross-section a transmitter made by the Si-MMWIC technique for 77 GHz. As shown, a buried semiconductor layer 2, for example, arsenic (As) doped silicon (Si) having a layer resistance of 10 Ω/surface area, is formed in the front surface 11 of a Si substrate 1 having a specific resistance of 10,000 Ωm.

On this front side 11 of the substrate 1, an IMPATT-diode 3, which is a pn-diode having a submicron structure according to the prior art, is situated on and connected to the semiconductor layer 2. The IMPATT-diode 3 has, for example, a mesa (plateau) shape having a diameter of 20 μm. A conductor structure 4, made of a chromium layer having a thickness of 0.1 μm, is disposed on the front surface of the substrate and shaped on one side to form a slot resonator 5. The IMPATT-diode 3 is connected with the conductor structure 4 by the buried semiconductor layer 2 and by an electric lead 6 made, for example, of gold.

In the illustrated transmitter the rear surface 12 of the substrate 1 is structured in such a manner that planar faces 13 are formed parallel to the outer surface of the substrate 1 and partial lens faces 15 are formed perpendicular to the planar faces. In this manner the phase of the microwave radiation 22 is varied or altered.

A small portion 21 of the total produced radiation is radiated away over the front side of the planar waveguide structure. This radiation component 21 may be used advantageously for radiation-coupled frequency or power measuring or regulating assemblies, or may be applied as local oscillator power to a receiver mixer.

Figure 2:
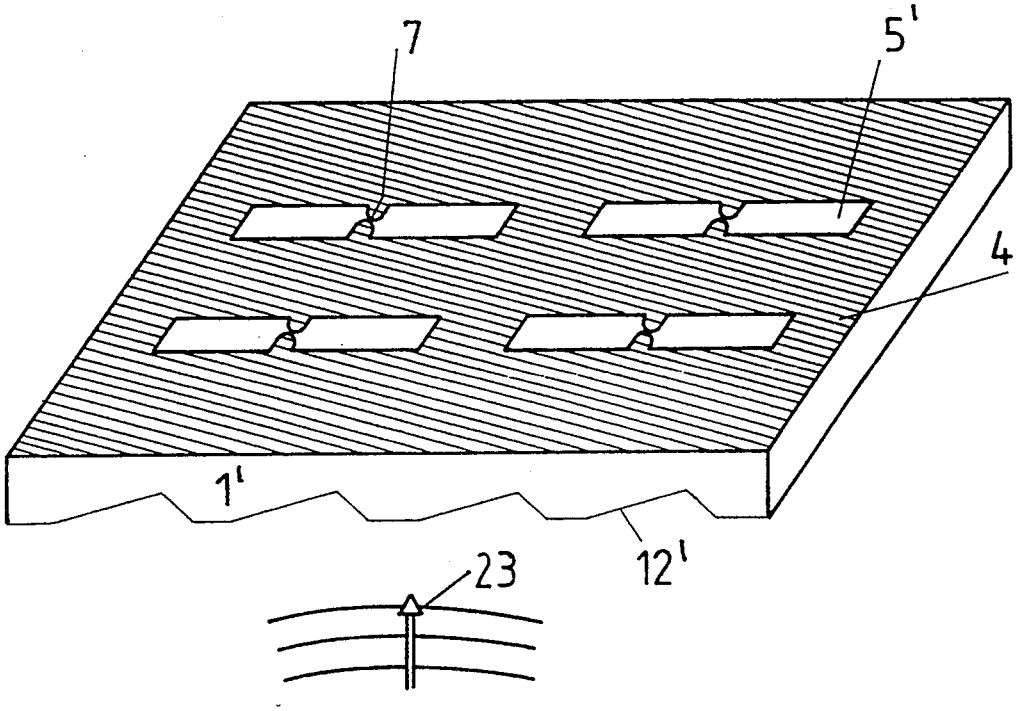
FIG. 2 is a schematic perspective view of another preferred embodiment of the invention.

For developing the planar waveguide structure into a planar receiver, instead of an IMPATT-diode 3 in the embodiment according to FIG. 1, a Schottky-diode 7, for example, is integrated into the planar waveguide structure as shown in FIG. 2. In such a receiver, the structured rear side 12' of the substrate 1' is utilized as an inwardly radiating surface for the received radiation 23.

As further shown in FIG. 2, the invention is not limited to individual transmitter or receiver elements but may find application in a circuit comprising a plurality of transmitters and/or receivers. For example, planar waveguide structures may be formed which have a plurality of side-by-side arranged radiating slit resonators 5. The outward radiation in such a receiver array is performed by the structured rear side of the substrate.

It will be understood that the above description of the present invention is susceptible to various modifications, changes and adaptations, and the same are intended to be comprehended within the meaning and range of equivalents of the appended claims.

What is claimed is:

1. In a planar waveguide structure for transmitters and receivers including a semiconductor substrate having a front surface and an opposite rear surface, and at least one active semiconductor component element connected with planar waveguide structures arranged on said front surface; the improvement wherein:

said rear surface of said semiconductor substrate is at least partially formed as at least one of an inwardly radiating surface and an outwardly radiating surface; and said rear surface of said substrate is geometrically shaped such that an electromagnetic property of incident or emanating electromagnetic radiation is altered in a predetermined manner and is formed of planar faces parallel to said rear surface and lens portions transverse to said rear surface.

2. The planar waveguide structure as defined in claim 1, wherein said at least one active semiconductor component element connected with planar waveguide structures, and provided on said front surface of said semiconductor substrate, generate and radiate outwardly directed microwave power.

3. The planar waveguide structure as defined in claim 1, wherein said at least one active semiconductor component element connected with planar waveguide structures, and provided on said front surface of said semiconductor substrate, receive and detect microwave power.

4. The planar waveguide structure as defined in claim 1, wherein said active semiconductor component structures and said planar waveguide structures on said front surface of said semiconductor substrate comprise a plurality of at least one of a transmitter and a receiver element.

5. In a planar waveguide structure for transmitters and receivers including a semiconductor substrate having a front surface and an opposite rear surface, and at least one active semiconductor component element connected with planar waveguide structures arranged on said front surface; the improvement wherein:

said rear surface of said semiconductor substrate is at least partially formed as at least one of an inwardly radiating surface and an outwardly radiating surface; and said rear surface of said semiconductor substrate is geometrically shaped such that an electromagnetic property of incident or emanating electromagnetic radiation is altered in a predetermined manner and is formed as a diffraction grid.

6. In a planar waveguide structure for transmitters and receivers including a semiconductor substrate having a front surface and an opposite rear surface, and at least one active semiconductor component element connected with planar waveguide structures arranged on said front surface; the improvement wherein:

said rear surface of said semiconductor substrate is at least partially formed as at least one of an inwardly radiating surface and an outwardly radiating surface; and at least one additional layer is applied on said rear surface of said semiconductor substrate and is geometrically shaped such that an electromagnetic property of incident or emanating electromagnetic radiation is altered in a predetermined manner, with said at least one additional layer including a layer of reflecting metal structures arranged on said rear surface of said semiconductor substrate to geometrically shape said rear surface and alter said electromagnetic radiation.

7. The planar waveguide structure as defined in claim 11, wherein said at least one active semiconductor component element connected with planar waveguide structures, and provided on said front surface of said semiconductor substrate, generate and radiate outwardly directed microwave power.

8. The planar waveguide structure as defined in claim 6, wherein said at least one active semiconductor component element connected with planar waveguide structures, and provided on said front surface of said semiconductor substrate, receive and detect microwave power.

9. The planar waveguide structure as defined in claim 6, wherein said active semiconductor component structures and said planar waveguide structures on said front surface of said semiconductor substrate comprise a plurality of at least one of a transmitter and a receiver element.

10. In a planar waveguide structure for transmitters and receivers including a semiconductor substrate having a front surface and an opposite rear surface, and at least one active semiconductor component element connected with planar waveguide structures arranged on said front surface; the improvement wherein:

said rear surface of said semiconductor substrate is at least partially formed as at least an outwardly radiating surface and is geometrically shaped such that an electromagnetic property of incident or emanating electromagnetic radiation is altered in a predetermined manner; and said at least one active semiconductor component element connected with planar waveguide structures, and provided on said front surface of said semiconductor substrate, generate and radiate outwardly directed microwave power, with said at least one active semiconductor component element and said planar waveguide structures on said front surface of said semiconductor substrate including an integrated transmitter circuit containing a planar IMPATT-diode and a slot resonator.

11. In a planar waveguide structure for transmitters and receivers including a semiconductor substrate having a front surface and an opposite rear surface, and at least one active semiconductor component element connected with planar waveguide structures arranged on said front surface; the improvement wherein:

said rear surface of said semiconductor substrate is at least partially formed as at least an inwardly radiating surface and is geometrically shaped such that electromagnetic property of at least incident electromagnetic radiation is altered in a predetermined manner; and said at least one active semiconductor component element connected with planar waveguide structures, and provided on said front surface of said semiconductor substrate, receive and detect inwardly directed microwave power, with said at least one active semiconductor component element and said planar waveguide structures on said front surface of said semiconductor substrate including an integrated receiver circuit containing a planar Schottky-diode and a slot resonator.

12. In a planar waveguide structure for transmitters and receivers including a semiconductor substrate having a front surface and an opposite rear surface, and at least one active semiconductor component element connected with planar waveguide structures arranged on said front surface; the improvement wherein:

said rear surface of said semiconductor substrate is at least partially formed as at least one of an inwardly radiating surface and an outwardly radiating surface;

at least one additional layer is applied on said rear surface of said semiconductor substrate and is geometrically shaped such that an electromagnetic property of incident or emanating electromagnetic radiation is altered in a predetermined manner; and, said at least one active semiconductor component element connected with planar waveguide structures, and provided on said front surface of said semiconductor substrate, generate and radiate outwardly directed microwave power, with said at least one active semiconductor component element and said planar waveguide structures on said front surface of said semiconductor substrate including an integrated transmitter circuit containing a planar IMPATT-diode and a slot resonator.

13. The planar waveguide structure as defined in claim 12, wherein said at least one additional layer includes a layer of at least one of dielectric material domes and ferromagnetic material domes provided on said rear surface of said semiconductor substrate to geometrically shape said rear surface and alter said electromagnetic radiation.

14. In a planar waveguide structure for transmitters and receivers including a semiconductor substrate having a front surface and an opposite rear surface, and at least one active semiconductor component element connected with planar waveguide structure arranged on said front surface; the improvement wherein:

said rear surface of said semiconductor substrate is at least partially formed as at least one of an inwardly radiating surface and an outwardly radiating surface;

at least one additional layer is applied on said rear surface of said semiconductor substrate and is geometrically shaped such that an electromagnetic property of incident or emanating electromagnetic radiation is altered in a predetermined manner; and, said at least one active semiconductor component element connected with planar waveguide structures, and provided on said front surface of said semiconductor substrate, receive and detect microwave power, with said at least one active semiconductor component element and said planar waveguide structures on said front surface of said semiconductor substrate including an integrated receiver circuit containing a planar Schottky-diode and a slot resonator.

* * * * *